US006427530B1

(12) United States Patent
Krueger et al.

(10) Patent No.: US 6,427,530 B1
(45) Date of Patent: Aug. 6, 2002

(54) APPARATUS AND METHOD FOR FORMATION TESTING WHILE DRILLING USING COMBINED ABSOLUTE AND DIFFERENTIAL PRESSURE MEASUREMENT

(75) Inventors: Volker Krueger; Matthias Meister, both of Celle (DE); Per-Erik Berger, Vestre Amoy (NO)

(73) Assignee: Baker Hughes Incorporated, Houston, TX (US)

( * ) Notice: Subject to any disclaimer, the term of this patent is extended or adjusted under 35 U.S.C. 154(b) by 33 days.

(21) Appl. No.: 09/698,795

(22) Filed: Oct. 27, 2000

(51) Int. Cl.[7] ..... E21B 47/00; E21B 47/10; G01V 5/12; G01N 27/00

(52) U.S. Cl. ..... 73/152.46; 73/152.28; 73/152.52; 73/152.22; 73/152.04; 175/48; 175/50; 166/254.2

(58) Field of Search ..... 73/152.46, 152.52, 73/152.28, 152.27, 152.22, 152.31, 152.04, 152.03; 175/48, 50; 166/254.2, 250.01

(56) References Cited

U.S. PATENT DOCUMENTS

| | | | | | |
|---|---|---|---|---|---|
| 2,741,468 | A | * | 4/1956 | Alspaugh | 262/26 |
| 3,998,096 | A | | 12/1976 | Hanciulescu et al. | 73/151 |
| 4,435,978 | A | * | 3/1984 | Glatz | 73/155 |
| 4,441,362 | A | * | 4/1984 | Carlson | 73/155 |
| 4,872,507 | A | * | 10/1989 | Ronco, Sr. et al. | 166/57 |
| 4,974,446 | A | * | 12/1990 | Vigneaux | 73/155 |
| 5,250,806 | A | * | 10/1993 | Rhine-Knudsen et al. | 250/254 |
| 5,629,480 | A | * | 5/1997 | Herget | 73/152.46 |
| 5,661,236 | A | * | 8/1997 | Thompson | 73/152.18 |
| 5,794,696 | A | * | 8/1998 | Gibson et al. | 166/264 |
| 5,817,937 | A | * | 10/1998 | Beshoory et al. | 73/152.46 |
| 6,028,307 | A | * | 2/2000 | Young et al. | 250/256 |
| 6,176,129 | B1 | * | 1/2001 | Aquesse et al. | 73/152.31 |

* cited by examiner

*Primary Examiner*—Hezron Williams
*Assistant Examiner*—David J. Wiggins
(74) *Attorney, Agent, or Firm*—Madan, Mossman & Sriram, P.C.

(57) ABSTRACT

The present invention provides a tool and method for obtaining at least one parameter of interest such as pressure of a subterranean formation in-situ. The tool comprises a carrier member for conveying the tool into a borehole, at least one selectively extendable member mounted on the carrier member for separating the annulus into a first portion and a second portion, a first port exposable to formation fluid in the first portion, a second port exposable to a fluid containing drilling fluid in the second portion, a first sensor for determining a first value indicative of a first portion characteristic, a second sensor for determining a second value indicative of a second portion characteristic referenced to the first value. The method comprises conveying a tool into a borehole, separating the annulus into a first portion and a second portion by extending at least one selectively extendable member, exposing a first port to formation fluid in the first portion, exposing a second port to fluid in the second portion, determining a first value indicative of an absolute pressure in the first portion, determining a second value indicative of a differential pressure of the second portion referenced to the absolute pressure of the first portion, and combining the first and second values using a processor, the combination being indicative of formation pressure.

26 Claims, 3 Drawing Sheets

APPARATUS AND METHOD FOR FORMATION TESTING WHILE DRILLING USING COMBINED ABSOLUTE AND DIFFERENTIAL PRESSURE MEASUREMENT

BACKGROUND OF THE INVENTION

1. Field of the Invention

This invention generally relates to the testing of subterranean formations or reservoirs, and more particularly to an apparatus and method of acquiring highly accurate formation pressure information while drilling a well.

2. Description of the Related Art

To obtain hydrocarbons such as oil and gas, well boreholes are drilled by rotating a drill bit attached at a drill string end. The drill string may be a jointed rotatable pipe or a coiled tube. Boreholes may be drilled vertically, but directional drilling systems are often used for drilling boreholes deviated from vertical and/or horizontal boreholes to increase the hydrocarbon production. Modern directional drilling systems generally employ a drill string having a bottomhole assembly (BHA) and a drill bit at an end thereof that is rotated by a drill motor (mud motor) and/or the drill string. A number of downhole devices placed in close proximity to the drill bit measure certain downhole operating parameters associated with the drill string. Such devices typically include sensors for measuring downhole temperature and pressure, tool azimuth, tool inclination. Also used are measuring devices such as a resistivity-measuring device to determine the presence of hydrocarbons and water. Additional downhole instruments, known as measurement-while-drilling (MWD) or logging-while-drilling (LWD) tools, are frequently attached to the drill string to determine formation geology and formation fluid conditions during the drilling operations.

Boreholes are usually drilled along predetermined paths and proceed through various formations. A drilling operator typically controls the surface-controlled drilling parameters during drilling operations. These parameters include weight on bit, drilling fluid flow through the drill pipe, drill string rotational speed (r.p.m. of the surface motor coupled to the drill pipe) and the density and viscosity of the drilling fluid. The downhole operating conditions continually change and the operator must react to such changes and adjust the surface-controlled parameters to properly control the drilling operations. For drilling a borehole in a virgin region, the operator typically relies on seismic survey plots, which provide a macro picture of the subsurface formations and a pre-planned borehole path. For drilling multiple boreholes in the same formation, the operator may also have information about the previously drilled boreholes in the same formation.

Typically, the information provided to the operator during drilling includes borehole pressure, temperature, and drilling parameters such as WOB, rotational speed of the drill bit and/or the drill string, and the drilling fluid flow rate. In some cases, the drilling operator is also provided selected information about the bottomhole assembly condition (parameters), such as torque, mud motor differential pressure, torque, bit bounce and whirl, etc.

The downhole sensor data are typically processed downhole to some extent and telemetered uphole by sending a signal through the drill string or by transmitting pressure pulses through the circulating drilling fluid, i.e. mud-pulse telemetry.

Various types of drilling fluids are used to facilitate the drilling process and to maintain a desired hydrostatic pressure in the borehole. Pressurized drilling fluid (commonly known as the"mud" or"drilling mud") is pumped into a drill pipe through a central bore to rotate the drill motor and to provide lubrication to various members of the drill string including the drill bit. The drill pipe is rotated by a prime mover, such as a motor, to facilitate directional drilling and to drill vertical boreholes. The drill bit is typically coupled to a bearing assembly having a drive shaft which in turn rotates the drill bit attached thereto. Radial and axial bearings in the bearing assembly provide support to the drill bit against these radial and axial forces.

The drilling mud is mixed with additives at the surface to protect downhole components from corrosion, and to maintain a specified density. The mud density is manipulated based on the known or expected formation pressure. The mud in the borehole annulus is typically maintained at a pressure slightly higher than the surrounding formation. The mud may invade the formation causing contamination of the hydrocarbons or it may damage the formation if the mud pressure is too high. If the mud is maintained at a pressure too low for the surrounding formation, the formation fluid may flow into the annulus causing a pressure"kick". Neither result is desirable when drilling a well.

Formation testing tools may be Formation Testing While Drilling (FTWD) tools conveyed ito a borehole on a drill string as described above or a formation testing tool may be conveyed into a borehole on a wireline. A typical wireline tool is lowered into a well using an armored cable that includes electrical conductors for transferring data and power to and from the tool. A wireline tool is typically lowered to a predetermined depth, and measurements are taken as the tool is withdrawn from the well.

Wireline and FTWD tools are used for monitoring formation pressures, obtaining formation fluid samples and for predicting reservoir performance. Such formation testing tools typically contain an elongated body having an inflatable packer, a pad seal or both sealingly urged against a zone of interest in a well borehole to collect formation fluid samples in storage chambers placed in the tool.

Resistivity measurements, downhole pressure and temperature measurements, and optical analysis of the formation fluids have been used to identify the type of formation fluid, i.e., to differentiate between oil, water and gas present in the formation fluid and to determine the bubble point pressure of the fluids. The information obtained from one or more pressure sensors and temperature sensors, resistivity measurements and optical analysis is utilized to control parameters such as drawdown rate, i.e. the rate at which tool pressure is lowered, so as to maintain the drawdown pressure, i.e. the tool pressure during testing or sampling, above the bubble point and to determine when to collect the fluid samples downhole.

Formation temperature varies based on the depth and pressure at a given point, and circulating drilling fluid tends to provide a relatively constant temperature in the borehole that is below the natural formation temperature. Circulation of fluid must be stopped whenever a wireline is being used or when a FTWD tool is used in certain sampling or test applications. Whenever circulation of the drilling fluid is stopped, the borehole temperature begins to rise. This temperature change has a temperature gradient. The temperature gradient can be quite high, thus making some instruments inaccurate.

A pressure gradient test is a test wherein multiple pressure tests are taken as a wireline or FTWD test apparatus is conveyed through a borehole. Instruments used for pressure gradient tests typically experience the constant temperature and temperature gradient conditions described above. The purpose of the test is to determine the interface or contact points between gas, oil and water. Using a typical pressure test apparatus provides approximate pressure values, that may include large error due to temperature effects. Many systems compensate for the error by utilizing complicated estimating techniques and computers to analyze the test data and determine the formation pressure at a given point. It would be desirable to have highly accurate test data to avoid the need for analytical estimations.

The present invention addresses the above-noted deficiencies and provides an apparatus and method for obtaining highly accurate pressure measurements of a formation for better control of drilling fluid hydrostatic pressure and for alleviating need for estimating formation pressure when using wireline and FTWD tools.

SUMMARY OF THE INVENTION

A Formation Testing While Drilling (FTWD) apparatus and a method are provided for obtaining highly accurate pressure measurements in a well borehole using a combination of an absolute and a differential pressure sensor for obtaining absolute pressure measurements under high temperature gradients. A high accuracy quartz absolute pressure sensor is used during a period of constant temperature. A sensor output defines a start range for a differential sensor, which has less absolute accuracy but is less susceptible to temperature effects of high temperature gradients.

The present invention uses a strain gauge, piezo resistive or similar pressure measurement system with a high resolution and good temperature compensation for a dynamic pressure measurement as a differential pressure measurement referenced to annulus pressure. A smaller full scale range pressure measurement gauge is then utilized resulting in better resolution. The strain gauge or similar system has the advantage of better temperature compensation compared to a high resolution quartz gauge used for absolute pressure measurements. However, to achieve an absolute pressure, a quartz gauge is needed to measure the absolute annulus pressure and then the differential pressure is added to it. This method has the advantage to measure very accurately the absolute pressure with the quartz gauge at constant temperature situations e.g. before mud circulation is stopped. The value is used for adjusting the initial annulus pressure setting of the differential pressure gauge measuring the draw down pressure at a temperature increase due to stopped circulation. Thus, the differential pressure gauge is used to measure the draw down pressure against annulus pressure while the quartz gauge measures the annulus pressure.

In one aspect of the present invention, a tool is provided for obtaining at least one parameter of interest such as pressure of a subterranean formation in-situ. The tool comprises a carrier member for conveying the tool into a borehole, at least one selectively extendable member mounted on the carrier member for separating the annulus into a first portion and a second portion, a first port exposed to formation fluid in the first portion, a second port exposed to a fluid containing drilling fluid in the second portion, a first sensor for determining a first value indicative of a first portion characteristic, a second sensor for determining a second value indicative of a second portion characteristic referenced to the first value. A method provided by the present invention comprises conveying a tool into a borehole, separating the annulus into a first portion and a second portion by extending at least one selectively extendable member, exposing a first port to formation fluid in the first portion, exposing a second port to fluid in the second portion, determining a first value indicative of an absolute pressure in the first portion, determining a second value indicative of a differential pressure of the second portion referenced to the absolute pressure of the first portion, and combining the first and second values using a processor, the combination being indicative of formation pressure.

BRIEF DESCRIPTION OF THE DRAWINGS

For detailed understanding of the present invention, reference should be made to the following detailed description of the preferred embodiment, taken is conjunction with the accompanying drawings, in which like elements have been given like numerals and wherein.

DESCRIPTION OF THE PREFERRED EMBODIMENTS

Figure 1:
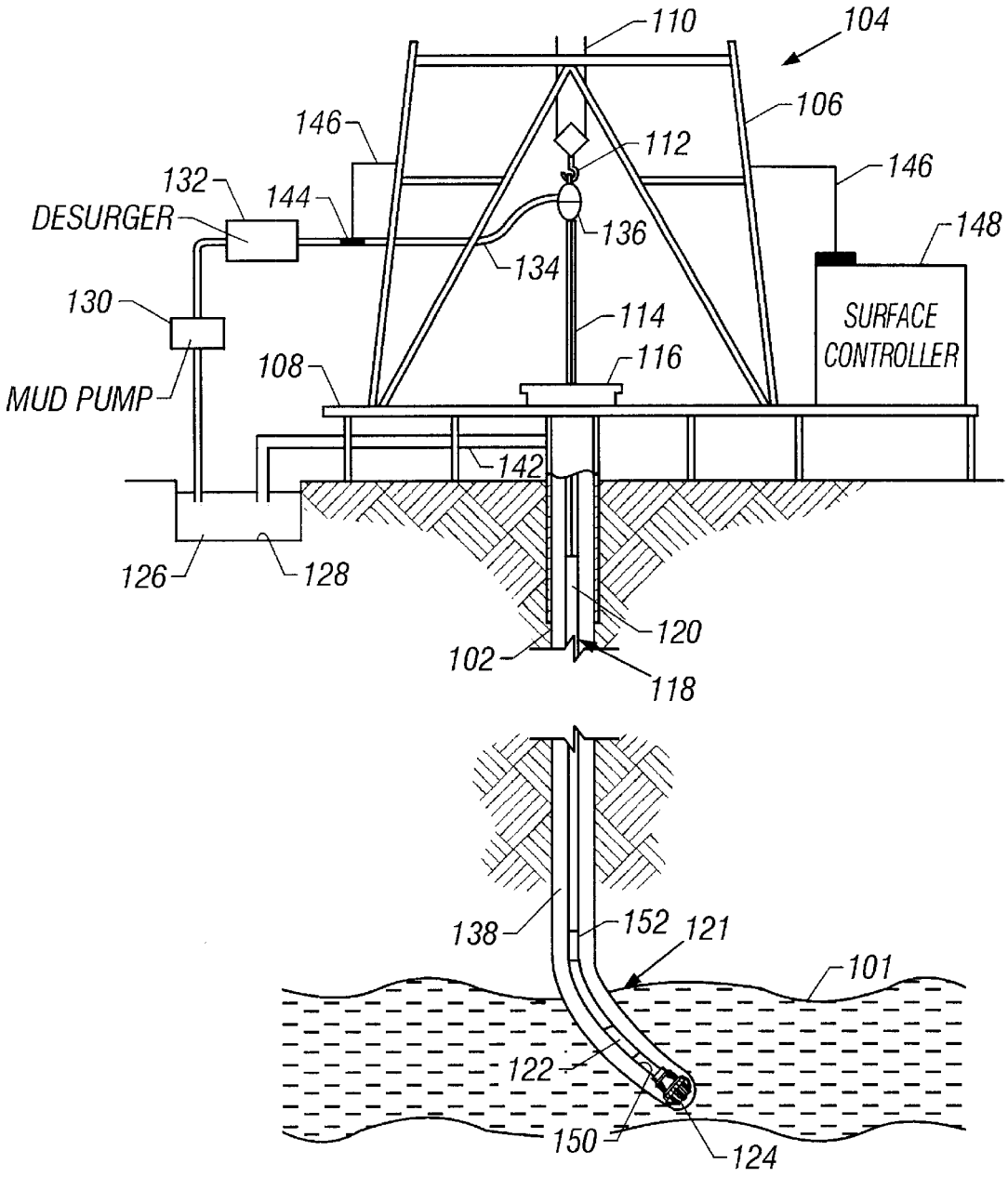
FIG. 1 is an elevation view of a simultaneous drilling and logging system that incorporates an embodiment of the present invention.

FIG. 1 is an elevation view of a simultaneous drilling and logging system that incorporates an embodiment of the present invention. A well borehole 102 is drilled into the earth under control of surface equipment including a rotary drilling rig 104. In accordance with a conventional arrangement, rig 104 includes a derrick 106, derrick floor 108, draw works 110, hook 112, kelly joint 114, rotary table 116, and drill string 118. The drill string 118 includes drill pipe 120 secured to the lower end of kelly joint 114 and to the upper end of a section comprising a plurality of drill collars. The drill collars include not separately shown drill collars such as an upper drill collar, an intermediate drill collar, and a lower drill collar bottom hole assembly (BHA) 121 immediately below the intermediate sub. The lower end of the BHA 121 carries a downhole tool 122 of the present invention and a drill bit 124.

Drilling mud 126 is circulated from a mud pit 128 through a mud pump 130, past a desurger 132, through a mud supply line 134, and into a swivel 136. The drilling mud 126 flows down through the kelly joint 114 and a longitudinal central bore in the drill string, and through jets (not shown) in the lower face of the drill bit. Borehole fluid 138 containing drilling mud, cuttings and formation fluid flows back up through the annular space between the outer surface of the drill string and the inner surface of the borehole to be circulated to the surface where it is returned to the mud pit through a mud return line 142. A shaker screen (not shown) separates formation cuttings from the drilling mud before the mud is returned to the mud pit.

The system in FIG. 1 uses mud pulse telemetry techniques to communicate data from down hole to the surface during drilling operations. To receive data at the surface, there is a transducer 144 in mud supply line 132. This transducer generates electrical signals in response to drilling mud pressure variations, and a surface conductor 146 transmits the electrical signals to a surface controller 148.

If applicable, the drill string 118 can have a downhole drill motor 150 for rotating the drill bit 124. Incorporated in the drill string 118 above the drill bit 124 is the downhole tool 122 of the present invention, which will be described in greater detail hereinafter. A telemetry system 152 is located in a suitable location on the drill string 118 such as above the tool 122. The telemetry system 152 is used to receive commands from, and send data to, the surface via the mud-pulse telemetry described above.

Figure 2:
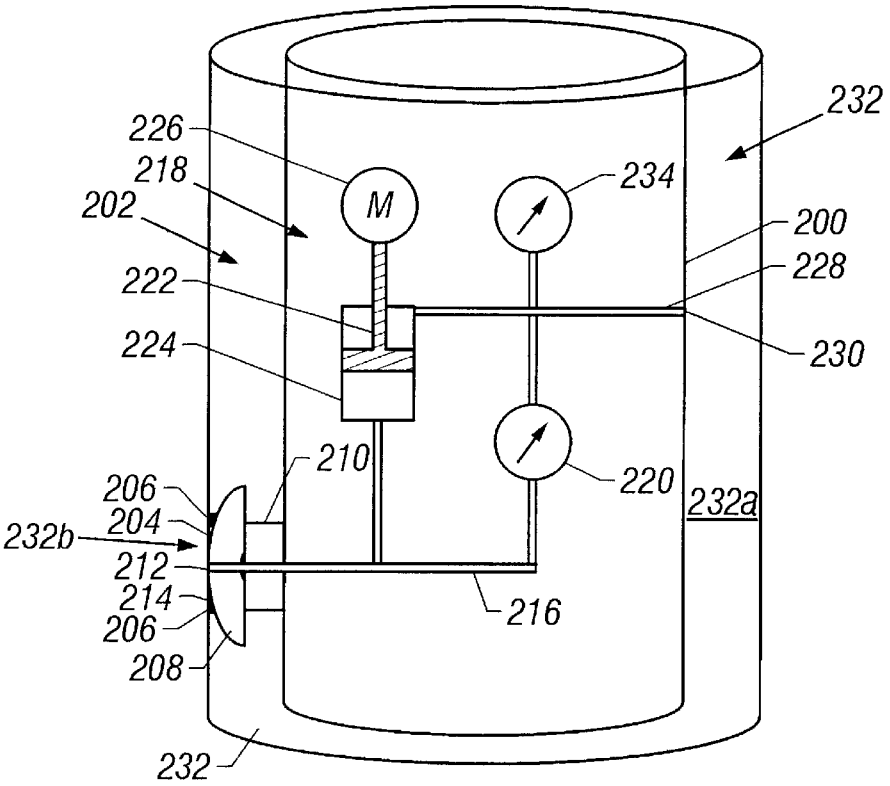
FIG. 2 is a plan view of a drill string section including a tool according to the present invention.

FIG. 2 is a plan view of a section of drillstring including a tool according to the present invention that may be used in the apparatus of FIG. 1. The tool 202 is shown disposed on an elongated cylinder that could be a drill pipe 200 coiled tube or a wireline. An extendable pad seal 204 includes a rubber or similar elastomer seal 206 at a pad end section 208. The pad end section 208 is attached to a piston 210 or other suitable deployment device such as a rib or packer. The piston 210 is housed in the drill pipe 200 and having a longitudinal axis substantially perpendicular to a longitudinal axis of the drill pipe 200. Any known method of extending and/or retracting the piston 210 may be used, such as mud pressure diversion through valves, hydraulic actuation using an electric or mud-turbine pump or by using an electric motor. The piston 210 may be biased in an extended or retracted position using for example, a spring (not shown). When extended, the pad seal 204 seals a portion of the annulus 232 thereby separating the annulus into a first portion 232*a* and a second portion 232*b*.

A first port 230 and conduit 228 allows fluid communication between the first portion of annulus 232*a* and an absolute pressure gauge 234. The absolute pressure gauge 234 is preferably a highly accurate quartz sensor gauge. The absolute pressure gauge 234 measures pressure in the first portion of annulus 232*a*, and the measurement is preferably taken when the temperature is relatively constant e.g. when the drilling fluid is circulating or for a period of time immediately after circulation is stopped.

A second port 212 is located on the pad end section 208. The second port 212 becomes in fluid communication with the borehole wall 214 at the second portion of sealed annulus 232*b* when the piston 210 is extended. When the elastomer seal 206 is sealed against the borehole wall 214 only formation fluid to flow through the second port 212. The second port 212 is connected to a differential pressure gauge 220 by a conduit 216. The differential pressure gauge 220 measures the differential pressure between the first and second annulus portions 232*a* and 232*b* during periods of high temperature gradients e.g. when drilling fluid is not circulating. The differential pressure gauge 220 is preferably a strain gauge type sensor, piezo-resistive sensor or similar system having high resolution and good temperature compensation for a dynamic pressure measurement as a differential pressure measurement referenced to annulus pressure. A smaller full scale range pressure measurement gauge (not separately shown) is then utilized resulting in better resolution. The strain gauge or similar system has the advantage of better temperature compensation compared to a high resolution quartz gauge used for absolute pressure measurements. However, to achieve an absolute pressure, a quartz gauge is needed to measure the absolute annulus pressure and then the differential pressure is added to it.

The absolute pressure gauge 234 and the differential pressure gauge 220 are operatively associated such that the absolute pressure gauge 234 provides a start range for the differential pressure gauge 220. In this manner, the differential pressure gauge 220 is measuring a pressure with respect to the absolute pressure reading. This configuration allows for:a smaller differential pressure reading scale. Differential pressure sensors of the type described herein are much more accurate for smaller differential pressures. Thus the combination of absolute and differential pressures provides a highly accurate pressure reading.

Still referring to FIG. 2, a pump 218 is used to urge fluid into the second port 212. The pump 218 may be any suitable fluid control device for the application. A preferable pump configuration utilizes a piston 222 reciprocally translated in a cylinder 224 and driven by an electric, hydraulic or mud motor 226. Fluid exiting the cylinder 224 may be deposited through conduit 228 and first port 230 into the first portion of annulus 232*a* not sealed by the pad seal 204. Alternatively, the fluid may exit the tool via any other suitable conduit and port (not shown).

Figure 3:
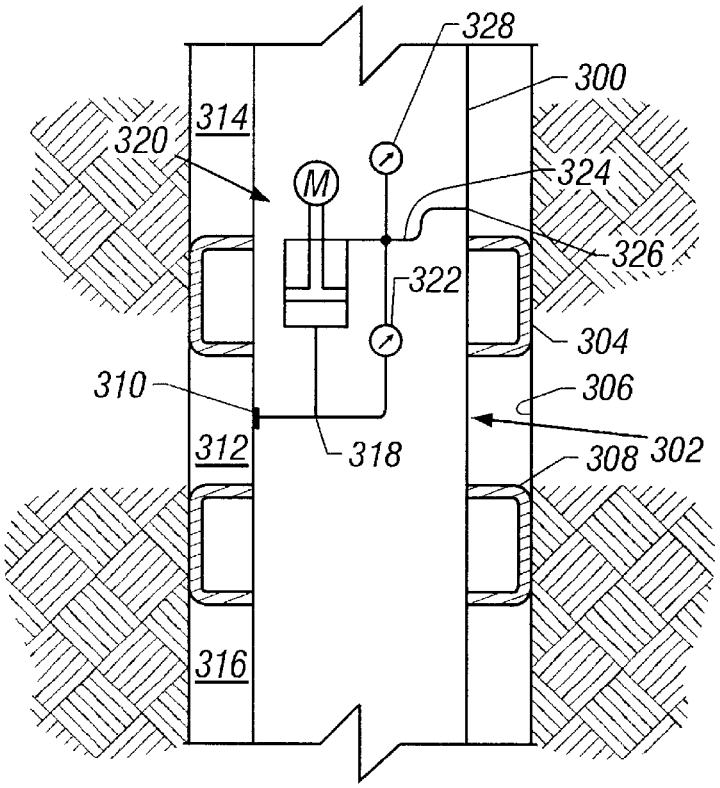
FIG. 3 shows another embodiment of the present invention wherein packers are used to seal a portion of annulus in a borehole.

FIG. 3 shows another embodiment of the present invention, wherein expandable packers are used to separate a borehole annulus into a lower annulus, an intermediate annulus and an upper annulus. Shown in FIG. 3 is a tool 302 located on an elongated tube 300 that could be part of a drill string or a wireline. An upper packer 304 is disposed on the tube 300 and is shown expanded sealed against the borehole wall 306. A lower packer 308 is likewise shown expanded and sealed against the borehole wall 306 at a second location below the upper packer 304. These packers are well known in the art and are typically inflated using drilling fluid.

A port 310 is exposed to a portion of annulus 312 sealed from an upper portion 314 and lower portion 316 by the packers, 304 and 308. A conduit 318 leads from the port 310 to a pump 320. The pump 320 is as described above and shown in FIG. 2. A differential pressure gauge 322 is connected to conduit 318 and a second conduit 324 leading to a port 326 to measure the pressure of the intermediate annulus with respect to the upper annulus 314. A highly accurate absolute pressure gauge 318 is connected to the second conduit 324 to measure the absolute pressure of the upper annulus 314. The intermediate annulus is preferably measured with respect to the upper annulus 314 rather than with respect to the lower annulus 316 to ensure measurements are not affected by pressure buildup in the lower annulus 316.

Figure 4:
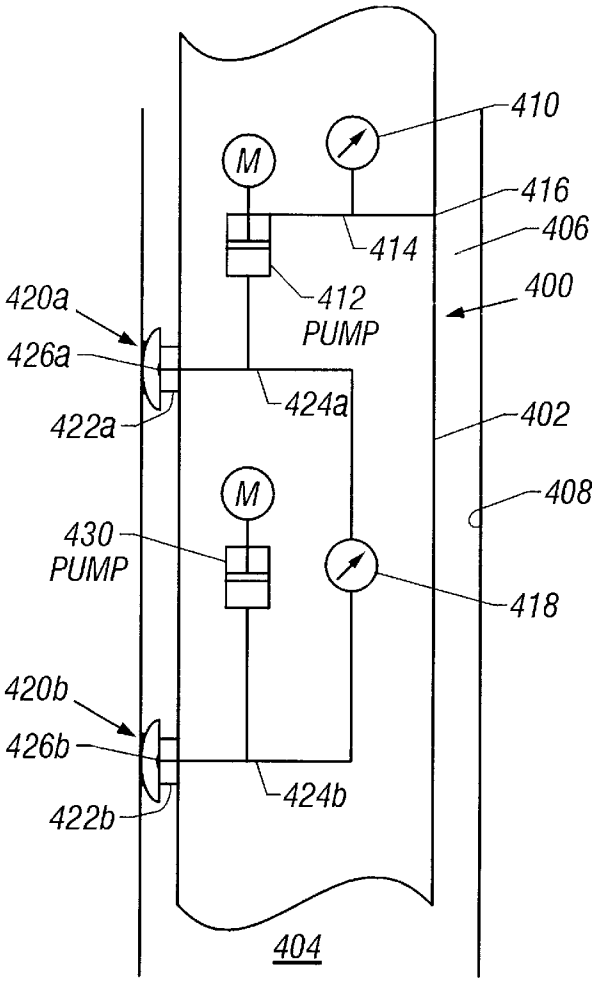
FIG. 4 shows an alternative embodiment of the present invention, wherein a differential pressure measurement is taken between two points on a borehole wall while an absolute pressure sensor measures an annular absolute pressure.

FIG. 4 shows an alternative embodiment of the present invention, wherein a differential pressure measurement is taken between two points on a borehole wall while an absolute pressure sensor measures an annular absolute pressure. A drill string sub or drill pipe 402 suitable for use with the apparatus described above and shown in FIG. 1 is shown disposed in a borehole 404 defining an annular space (annulus) 406 between the tool 400 and the borehole wall 408.

The tool 400 includes an absolute pressure gauge 410. The absolute pressure gauge 410 is connected to a pump 412 by a conduit 414. The conduit 414 has a port 416 exposed to the annulus 406, to enable the measuring of the absolute fluid pressure in the annulus 406 with the absolute pressure gauge 410.

The tool 400 also includes a differential pressure gauge 418. The differential pressure gauge 418 is coupled to a plurality of pad sealing elements (pads) 420*a* and 420*b* which are substantially identical to the pad described above and shown in FIG. 2. Each pad sealing element is mounted on an extendable piston 422*a* and 422*b* for extending the associated pad toward the borehole wall 408. A conduit 424*a* extends from a port 426*a* located in one pad 420*a* to the one side of the differential pressure gauge 418, and a similar conduit 424*b* connects another port 426*b* located in the other pad 420*b* to another side of the differential pressure gauge 418. Each pad 420*a* and 420*b* seals a separate portion of the borehole wall 408 thereby exposing the associated port to the sealed wall portion. A fluid pump 430 is used to urge formation fluid from the formation into the port 426b. In the embodiment shown FIG. 4, the first pump 412 is connected to the conduit 414 leading to the absolute pressure gauge 410 and to the conduit 424*a* connecting the port 426*a* to the differential pressure gauge 418. Those versed in the art would recognize that multiple configurations capable of drawing fluid into a tool via one or more ports exist and that the configuration shown in FIG. 4 is merely illustrative of one such configuration. For example, a separate pump may be coupled to each port or a single pump with properly routed conduits could connect all ports and gauges and still be functionally equivalent to the embodiment shown. The intent of the present description is to include all such configurations.

Figure 5:
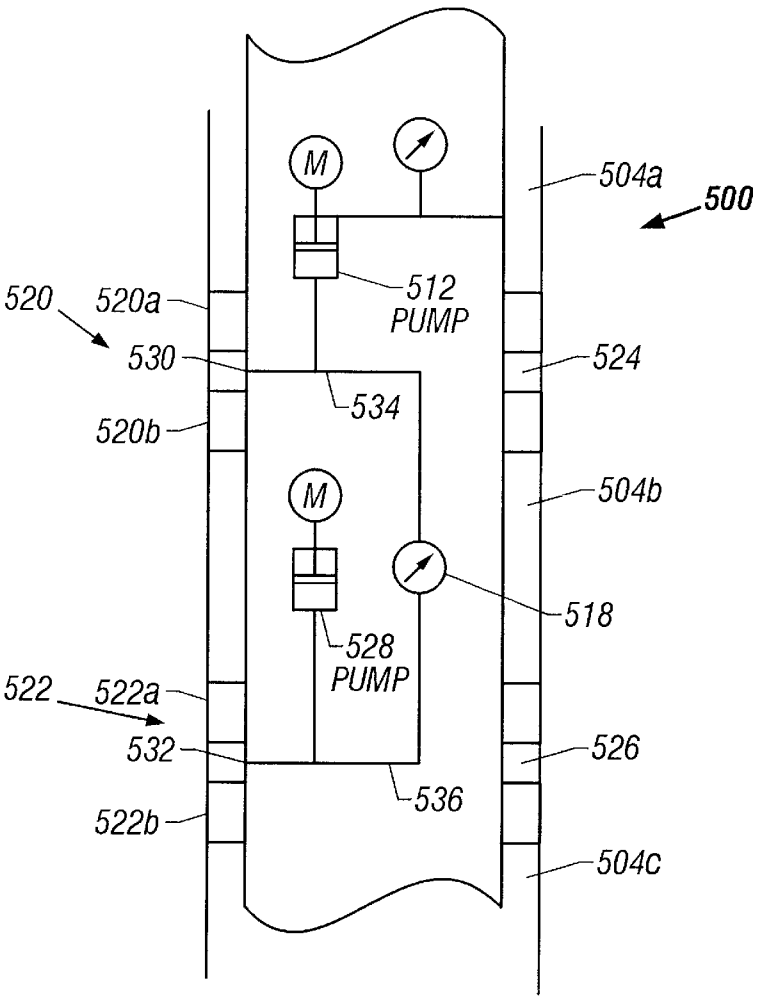
FIG. 5 shows an alternative embodiment of a tool according to the present invention, wherein a differential pressure measurement is taken between two annular portions isolated by dual sets of packers.

FIG. 5 shows an alternative embodiment of a tool 500 according to the present invention, wherein a differential pressure measurement is taken between two annular portions isolated by dual sets of packers. The tool 500 shown in FIG. 5 is substantially identical to the tool described above and shown in FIG. 4, with the exception being the extendable pad elements of FIG. 4 are replaced with dual sets of packers comprising an upper packer set 520 and a lower packer set 522.

The packer sets 520 and 522 are typical expandable packers known in the art such as those described above and shown in FIG. 3. The upper packer set 520 comprises a first upper packer 520*a* and a second upper packer 520*b*. Drilling fluid may be used to inflate the packers 520*a* and 520*b* using known pumping and fluid routing methods. The packers 520*a* and 520*b* when inflated seal an upper portion 524 of the annulus and further separate the annulus into an upper portion 504*a* above the upper packer set 520 and an intermediate portion 504*b* between the upper and lower packer sets 520 and 522.

The lower packer set 522 comprises a first lower packer 522*a* and a second lower packer 522*b*. The lower packer set 522 is substantially identical to the upper packer set 520. The first and second lower packers 522*a* and 522*b* inflate to seal a lower portion 526 of the annulus and to further separate the annulus into a bottom portion 504*c* below the lower packer set 522.

An upper port 530 and a lower port 532 are exposed to the upper and lower sealed portions 524 and 526 of the annulus respectively. A differential pressure gauge 518 is disposed in the tool 500 and is coupled to the upper port 530 by a conduit 534. The differential pressure gauge 518 is connected to the lower port 532 by a similar conduit 536. A second pump 528 is coupled to the conduit 536 for urging formation fluid into the lower sealed portion 526 of annulus, while the first pump 512 urges formation fluid into the upper sealed portion 524 and the associated upper port 530. As with the embodiment described above and shown in FIG. 4, the pump configuration of FIG. 5 is an exemplary configuration and functional equivalent configurations are considered within the scope of the present invention.

Still referring to FIG. 5, the differential pressure gauge 518 measures the differential pressure between the two sealed portions 524 and 526 of annulus under high temperature gradients while the absolute pressure gauge 510 measures the absolute pressure of the upper annulus 504*a* when the temperature is relatively constant. The two pressure gauges 510 and 518 are operatively associated such that the absolute pressure gauge 510 provides a start value for the differential pressure gauge 518. A not-shown processor is used to combine the measurements of the pressure gauges to determine an accurate formation absolute pressure reading.

Various apparatus embodiments of the present invention having been described above and shown in FIGS. 1–5, methods for measuring a formation pressure according to the present invention will now be described. The methods may utilize one or more of the apparatus embodiments or any tool providing similar functional capability. The method descriptions following will use particular embodiments of the tool described above for illustrative purposes only without limiting any particular method embodiment to the use of a particular configuration of tool.

The tool described above and shown in FIG. 2 is used in one embodiment of the method of the present invention to determine formation pressure. The method comprises lowering a tool 202 into a well borehole using a drill pipe, coiled tube or wireline. A quartz or other absolute pressure gauge 234 housed in the tool is used to determine an absolute pressure reading in the annulus while the drilling mud is circulating and the temperature is relatively constant. A portion of the annulus is separated and sealed from the rest of the annulus using an extendable pad sealing element 204. Formation fluid is urged into a port exposed to the sealed portion of annulus. A strain gauge or similar pressure measurement system 220 having high resolution and good temperature compensation for the dynamic pressure measurement is used to measure a differential pressure of the fluid entering the port with respect to annulus pressure. A smaller full scale range pressure measurement gauge can be utilized resulting in better resolution.

The strain gauge system has the advantage of better temperature compensation compared to the high resolution quartz gauge for the absolute pressure measurements, but the absolute pressure gauge is necessary to obtain the initial pressure, and then the differential pressure value is added to it. This method has the advantage of measuring very accurately the absolute pressure with the quartz gauge at constant temperature situations before mud circulation is stopped, and the absolute value is then used for adjusting an annulus pressure of the differential pressure gauge.

The differential pressure gauge is then used to measure draw down pressure while temperature increases due to stopped circulation. The differential pressure is measured with respect to the annulus pressure while the quartz gauge provides a very accurate measurement of the annulus pressure. A processor is used to process the measured differential and absolute pressure measurements to determine a highly accurate value of the formation pressure and/or determine fluid density in the borehole.

It should be appreciated that the tool described above and shown in FIG. 3 provides a substantially equivalent function as the tool of FIG. 2. Thus, any method described herein using the tool of FIG. 2 is equally adaptable to the use of the tool of FIG. 3.

Alternative methods for obtaining formation pressure according to the present invention will now be described using the apparatus described above and shown in FIG. 4 as an exemplary tool for carrying out the method. The tool 400 is conveyed into a borehole using a drill pipe, coiled tube or wireline to a desired depth. A plurality of extendable pads

420*a* and 420*b* are extended to seal two separate portions of the annulus from each other and from the rest of the annulus. A quartz absolute pressure gauge 410 is used to measure the absolute pressure of the unsealed portion of annulus while drilling fluid is circulating. One or more pumps are used to draw fluid containing formation fluid into ports exposed to each of the sealed annular portions. A strain gauge or other suitable differential pressure sensor is used to measure the differential pressure of one port with respect to the other. A processor is used to combine the differential pressure measurement with the absolute pressure measurement in determining a value indicative of the formation pressure. The formation pressure value is then telemetered to the surface for use in controlling drilling operations. It should be appreciated that the tool described above and shown in FIG. 5 provides a substantially equivalent function as the tool of FIG. 4. Thus, the method just described using the tool of FIG. 4 is equally adaptable to the use of the tool in FIG. 5.

In an alternative method, pressure measurements taken as described above are taken at multiple locations along a borehole path. The measurements are analyzed to determine interface or contact points between gas, oil and water contained in the formation.

In another method, at least one pressure measurement taken as described above is processed to determine the efficiency of drilling fluid in maintaining a desired hydrostatic pressure in the borehole. The processed measurements are transmitted to a surface location via any transmission known in the art and suitable for the application. A drilling operator uses the transmitted information to adjust drilling fluid parameters, thereby improving the efficiency of the drilling operation.

The foregoing description is directed to particular embodiments of the present invention for the purpose of illustration and explanation it will be apparent, however, to one skilled in the art that many modifications and changes to the embodiments set forth above are possible without departing from the scope and the spirit of the invention. It is intended that the following claims be interpreted to embrace all such modifications and changes.

We claim:

1. A tool for obtaining a parameter of interest of a subterranean formation in-situ, the tool comprising:

(a) a carrier member for conveying the tool into a borehole, the borehole and tool having an annulus therebetween;

(b) at least one selectively extendable member mounted on the carrier member for separating the annulus into a plurality of annulus portions;

(c) a first sensor operatively associated with at least one of the annulus portions for determining a first value characteristic of the at least one portion associated with the first sensor; and (d) a second sensor operatively associated with at least one of the annulus portions for determining a second value characteristic of the at least one portion associated with the second sensor, a combination of the first and second values being indicative of the parameter of interest.

2. The tool of claim 1, wherein the carrier member is selected from a group consisting of (i) a rotatable drill pipe, (ii) a coiled tube and (iii) a wireline.

3. The tool of claim 1, wherein the parameter of interest is selected from a group consisting of (i) formation pressure and (ii) contact points.

4. The tool of claim 1, wherein the at least one selectively extendable member is selected from a group consisting of (i) an extentable pad sealing element and (ii) an expandable packer.

5. The tool of claim 1, wherein the first sensor is an absolute pressure gauge.

6. The tool of claim 5, wherein the absolute pressure gauge further comprises a quartz pressure sensor.

7. The tool of claim 1, wherein the second sensor is a differential pressure gauge.

8. The tool of claim 7, wherein the differential pressure gauge further comprises a strain gauge pressure sensor.

9. The tool of claim 1 further comprising a pump in fluid communication with the first port for urging formation fluid into the first port.

10. The tool of claim 1 further comprising a processor disposed on the tool for combining the first and second values in determining the parameter of interest.

11. A tool for obtaining a formation parameter of interest in-situ, the tool comprising:

(a) a carrier member for conveying the tool into a borehole, the borehole and tool having an annulus therebetween;

(b) at least one selectively extendable member mounted on the carrier member for separating the annulus into a first portion and a second portion;

(c) a first port exposable to a fluid containing formation fluid in the first portion, (d) a second port exposable to a fluid containing drilling fluid in the second portion;

(e) an absolute pressure sensor operatively associated with the first portion for determining a first value indicative of a absolute pressure in the first portion;

(f) a differential pressure sensor operatively associated with the first port and second port for determining a second value indicative of a differential pressure of the second portion referenced to the absolute pressure of the first portion determined by the absolute pressure sensor.

(g) a processor for combining the first and second values, the combination being indicative of formation pressure.

12. The tool of claim 1, wherein the extendable member is an extendable pad sealing element, the plurality of annulus portions comprises a first annulus portion and a second annulus portion sealed by the extendable pad seal, the first sensor is an absolute pressure sensor and the first value is an absolute pressure value of the first portion, and the second sensor is a differential pressure sensor and the second value is a differential pressure value of the second annulus portion measured with respect to the first annulus portion.

13. The tool of claim 1, wherein the extendable member comprises a first extendable pad sealing element and a second extendable pad sealing element, the plurality of annulus portions comprises a first annulus portion, a second annulus portion sealed by the first extendable pad seal and a third annulus portion sealed by the second extendable pad seal, the first sensor is an absolute pressure sensor and the first value is an absolute pressure value of the first portion, and the second sensor is a differential pressure sensor and the second value is a differential pressure value of the second annulus portion measured with respect to the third annulus portion.

14. The tool of claim 1, wherein the extendable member is an expandable packer set, the plurality of annulus portions comprises a first annulus portion and a second annulus portion sealed by the expandable packer set, the first sensor is an absolute pressure sensor and the first value is an absolute pressure value of the first portion, and the second sensor is a differential pressure sensor and the second value is a differential pressure value of the second annulus portion measured with respect to the first annulus portion.

15. The tool of claim 1, wherein the extendable member comprises a first expandable packer set and a second expandable packer set, the plurality of annulus portions comprises a first annulus portion, a second annulus portion sealed by the first expandable packer set and a third annulus portion sealed by the second expandable packer set, the first sensor is an absolute pressure sensor and the first value is an absolute pressure value of the first portion, and the second sensor is a differential pressure sensor and the second value is a differential pressure value of the second annulus portion measured with respect to the third annulus portion.

16. A method for obtaining a parameter of interest of a subterranean formation in-situ, the method comprising:

(a) conveying a tool into a well borehole on a carrier member, the borehole and tool having an annulus therebetween;

(b) separating the annulus into a plurality of annulus portions using at least one selectively extendable member mounted on the carrier member;

(d) determining a first value characteristic of at least one of the annulus portions using a first sensor operatively associated with the at least one annulus portion;

(e) determining a second value characteristic of at least one of the annulus portions using a second sensor operatively associated with the at least one annulus portion; and (f) determining the parameter of interest by combining the first and second values.

17. The method of claim 16, wherein conveying the tool into a well borehole further comprises conveying the tool using a carrier member selected from a group consisting of (i) a rotatable drill pipe, (i) a coiled tube and (iii) a wireline.

18. The method of claim 16, wherein obtaining at least one parameter of interest is obtaining a parameter of interest selected from a group consisting of (i) formation pressure and (ii) contact points.

19. The method of claim 16, wherein using an extendable member is selected from a group consisting of (i) using an extendable pad sealing element and (ii) using an expandable packer.

20. The method of claim 16 further comprising using an absolute pressure gauge as the first sensor.

21. The method of claim 20 further comprising using an absolute pressure gauge having a quartz pressure sensor.

22. The method of claim 16 further comprises using a differential pressure gauge as the second sensor.

23. The method of claim 22 further comprising using a differential pressure gauge having a strain gauge pressure sensor.

24. The method of claim 16 further comprising urging formation fluid into the first port with a pump.

25. The method of claim 16 further comprising combining the first and second values with a processor in determining the parameter of interest.

26. A method for obtaining a parameter of interest of a subterranean formation in-situ, the tool comprising:

(a) conveying a tool into a borehole on a carrier member, the borehole and tool having an annulus therebetween;

(b) separating the annulus into a first portion and a second portion by extending at least one selectively extendable member mounted on the carrier member;

(c) exposing a first port to a fluid containing formation fluid in the first portion;

(d) exposing a second port to a fluid containing drilling fluid in the second portion;

(e) determining a first value indicative of a absolute pressure in the first portion using an absolute pressure sensor operatively associated with the first portion;

(f) determining a second value indicative of a differential pressure of the second portion referenced to the absolute pressure of the first portion using a differential pressure sensor operatively associated with the first port and the second port; and (g) combining the first and second values using a processor, the combination being indicative of formation pressure.

* * * * *